US008054282B2

(12) United States Patent
Park et al.

(10) Patent No.: US 8,054,282 B2
(45) Date of Patent: Nov. 8, 2011

(54) FIELD SEQUENTIAL COLOR MODE LIQUID CRYSTAL DISPLAY DEVICE AND METHOD OF DRIVING THE SAME

(75) Inventors: Su-Hyun Park, Gyeonggido (KR); Ku-Hyun Park, Gyeonggido (KR); Young-Nam Lim, Seoul (KR); Sang-Ho Choi, Busan (KR); Jong-Hoon Woo, Gyeonggido (JP)

(73) Assignee: LG Display Co., Ltd., Seoul (KR)

( * ) Notice: Subject to any disclaimer, the term of this patent is extended or adjusted under 35 U.S.C. 154(b) by 538 days.

(21) Appl. No.: 11/107,731

(22) Filed: Apr. 18, 2005

(65) Prior Publication Data

US 2005/0231453 A1 Oct. 20, 2005

(30) Foreign Application Priority Data

Apr. 16, 2004 (KR) ..... 10-2004-0026338

(51) Int. Cl.
*G09G 3/36* (2006.01)

(52) U.S. Cl. ..... 345/101; 345/87; 345/88; 345/99; 345/102

(58) Field of Classification Search ..... 345/55, 345/63, 72, 87–88, 94, 99, 101, 102
See application file for complete search history.

(56) References Cited

U.S. PATENT DOCUMENTS

| | | | | |
|---|---|---|---|---|
| 4,902,107 | A * | 2/1990 | Tsuboyama et al. | 349/72 |
| 5,684,503 | A * | 11/1997 | Nomura et al. | 345/97 |
| 6,115,021 | A * | 9/2000 | Nonomura et al. | 345/101 |
| 6,774,883 | B1 * | 8/2004 | Muhlemann | 345/101 |
| 6,930,667 | B1 * | 8/2005 | Iijima et al. | 345/101 |
| 7,825,889 | B2 * | 11/2010 | Kim et al. | 345/101 |
| 7,864,152 | B2 * | 1/2011 | Park et al. | 345/98 |
| 2003/0010894 | A1 * | 1/2003 | Yoshihara et al. | 250/208.1 |
| 2003/0103026 | A1 * | 6/2003 | Yamakawa et al. | 345/87 |
| 2003/0107546 | A1 * | 6/2003 | Ham | 345/101 |
| 2003/0132901 | A1 * | 7/2003 | Shimada | 345/87 |
| 2005/0041007 | A1 * | 2/2005 | Iijima | 345/101 |
| 2005/0179639 | A1 * | 8/2005 | Hsieh | 345/102 |
| 2005/0190171 | A1 * | 9/2005 | Jang et al. | 345/204 |

FOREIGN PATENT DOCUMENTS

| | | |
|---|---|---|
| JP | 2001-142049 | 5/2001 |
| JP | 2002-281517 | 9/2002 |

* cited by examiner

*Primary Examiner* — Jason Mandeville

(74) *Attorney, Agent, or Firm* — McKenna Long & Aldridge, LLP

(57) ABSTRACT

A liquid crystal display device includes a temperature-sensing unit measuring at least one of a temperature of the liquid crystal display device and an ambient temperature of the liquid crystal display device, and outputting a frequency modulation signal corresponding to the measured temperature, a timing controller modulating a frequency of a clock signal based on the frequency modulation signal to generate a modulated clock signal, and treating a video data based on the modulated clock signal to generate a treated video data, and a display panel displaying an image based on the modulated clock signal and the treated video data, the display panel including a gate line, a data line crossing the gate line and a switching element connected to the gate line and the data line.

13 Claims, 6 Drawing Sheets

FIELD SEQUENTIAL COLOR MODE LIQUID CRYSTAL DISPLAY DEVICE AND METHOD OF DRIVING THE SAME

The present invention claims the benefit of Korean Patent Application No. 2004-0026338 filed in Korea on Apr. 16, 2004, which is hereby incorporated by reference.

BACKGROUND OF THE INVENTION

1. Field of the Invention

The present invention relates to a liquid crystal display device, and more particularly, to a field sequential color mode liquid crystal display device including a temperature-compensating circuit and a driving method thereof that compensate temperature variations and enhance display qualities.

2. Discussion of the Related Art

Cathode ray tubes (CRTs) have been widely used in televisions and monitors for display images. However, CRTs have disadvantages in that they are heavy and large. In addition, CRTs require a high driving voltage especially when having a larger display area. Accordingly, flat panel display (FPD) devices, such as liquid crystal display (LCD) devices, plasma display panel (PDP) devices, and organic electroluminescent display (ELD) devices have been the focus of recent researches because of their excellent characteristics of light weight and low power consumption.

In general, an LCD device is a non-self-emissive display device that displays images by controlling a transmittance of light emitted from a backlight unit through a liquid crystal panel. In particular, a cold cathode fluorescent lamp (CCFL) is widely used in the backlight unit for an LCD device. Such a backlight unit includes a lamp for emitting light, a lamp housing for surrounding the lamp, a light guiding plate for converting the light from the lamp into a plane light, a reflecting plate under the light guiding plate for upwardly reflecting downward and sideward light, a first diffusing sheet for diffusing the light from the light guiding plate, first and second prism sheets for adjusting a direction of light from the first diffusing sheet, and a second diffusing sheet for diffusing the light from the first and second prism sheets.

To form a small, thin and light-weighted backlight unit, a light emitting diode (LED) has been suggested to replaced the CCFL. An LCD device using a backlight unit having an LED may be driven using a field sequential color (FSC) driving method for obtaining a high display quality.

An FSC mode LCD device employs a light source including red-color, green-color and blue-color light sources, instead of a color filter layer having red, green and blue sub-color filters. In addition, in an FSC driving method, the red-color, green-color and blue-color light sources are sequentially turned on/off and an image of full color is displayed based on the persistence effect in human vision. Accordingly, one frame for displaying an image may be divided into three sub-frames that respectively correspond to red, green and blue color light emissions. Further, each light source is turned off during a time period of each sub-frame for writing a data and arranging liquid crystal molecules, and is turned on during the other time period of each sub-frame.

FIG. 1 is a schematic diagram showing a single time frame of a field sequential color (FSC) driving method for a liquid crystal display device according to the related art. In FIG. 1, one frame of about 16.7 ms is divided into three sub-frames of about 5.56 ms, R, G, and B, corresponding to red-color, green-color and blue-color light sources. Each of the sub-frames, R, G and B, is further divided into a first time period AP for inputting a data to a thin film transistor (TFT), a second time period WP for re-arranging liquid crystal molecules, and a third time period FP for emitting light using a light source including the red-color, green-color and blue-color light sources. Accordingly, each color-light source is turned on during the third time period FP of a respective sub-frame, but is turned off during the first and second time periods, AP and WP, of the respective sub-frame. As a result, the light source does not emit light during the entire duration of a frame.

In addition, an FSC mode LCD device may employ a light emitting diode (LED) in each of the color light sources, and in an FSC driving method, a data includes red, green and blue sub-data. Each sub-data is generated for one vertical sync time period, i.e., one frame, and the red, green and blue sub-data are sequentially supplied at an equal rate during the one vertical sync time period. As a result, the color-light sources do not simultaneously emit light, and the red-color, green-color and blue-color light sources are sequentially turned on. Since the red and green sub-data are supplied before the blue sub-data, red-color and green-color emissions need to be sustained for a longer period of time than blue color to obtain a white colored image. Thus, the light source is driven such that output intensities of the red-color and green-color light sources are higher than an output intensity of the blue-color light source, and a reduced response time of the liquid crystal molecules is required. For example, the first, second and third time periods AP, WP and FP of a sub-frame may be about 1.69 ms, about 1.5 ms and about 2.37 ms, respectively.

FIGS. 2A and 2B are images showing display qualities of an FSC mode liquid crystal display device according to the related art at different temperatures. FIG. 2A shows the display qualities of the FSC mode LCD device at a surrounding temperature of about 30° C., and FIG. 2B shows the display qualities of the FSC mode LCD device at a surrounding temperature of about −20° C. As shown in FIGS. 2A and 2B, when the surrounding temperature is about −20° C., the FSC mode LCD device produces an image having a lower contrast ratio and a lower color reproducibility in comparison to the image produced when the surrounding temperature is about 30° C. Such a decline in display qualities is caused by a deterioration of a switching element and an increase in response time of liquid crystal molecules when the LCD device is at a low temperature environment. Thus, the display qualities of an FSC mode LCD device considerably depends on temperature.

FIG. 3 is a collection of images showing display qualities of an FSC mode liquid crystal display device according to the related art at different temperatures. FIG. 3 represents blue, green, red, white and black images produced by the related-art FSC mode liquid crystal display device under a temperature range of about 20 to about −25° C. An upper portion and a lower portion of each image respectively correspond to a first gate line and a last gate line of the LCD device, respectively. That is, each image is produced by writing data from the upper portion to the lower portion of the FSC mode LCD device.

As shown in FIG. 3, the lower portion of the images displaying red and green colors begins to vary in color at about 5° C. and the lower portion of the images displaying blue color begins to vary in color at about 0° C. In addition, as the temperature further decreases, the whole portion of the FSC mode LCD device severely varies in color, because as the temperature decreases, a viscosity of liquid crystal molecules increases and a response speed of the liquid crystal molecules is reduced. Accordingly, the FSC mode LCD device of the related art does not display exact colors under a relatively low temperature. As a result, a contrast ratio and a color reproducibility of the FSC mode LCD device of the related art decrease as temperature varies, thereby deteriorating display qualities of the FSC mode LCD device.

SUMMARY OF THE INVENTION

Accordingly, the present invention is directed to a field sequential color mode liquid crystal display device and a driving method thereof that substantially obviate one or more of the problems due to limitations and disadvantages of the related art.

An object of the present invention is to provide a field sequential color mode liquid crystal display device having an improved contrast ratio and an improved color reproducibility under a relatively low temperature, and a driving method thereof.

Another object of the present invention is to provide a field sequential color mode liquid crystal display device having a temperature-compensating circuit controlling a driving frequency, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a temperature-sensing unit measuring at least one of a temperature of the liquid crystal display device and an ambient temperature of the liquid crystal display device, and outputting a frequency modulation signal corresponding to the measured temperature, a timing controller modulating a frequency of a clock signal based on the frequency modulation signal to generate a modulated clock signal, and treating a video data based on the modulated clock signal to generate a treated video data, and a display panel displaying an image based on the modulated clock signal and the treated video data, the display panel including a gate line, a data line crossing the gate line and a switching element connected to the gate line and the data line.

In another aspect, a temperature-compensating circuit for a liquid crystal display device includes a temperature-sensing unit measuring at least one of a temperature of the liquid crystal display device and an ambient temperature of the liquid crystal display device, and outputting a frequency modulation signal corresponding to the measured temperature, and a timing controller modulating a frequency of a clock signal based on the frequency modulation signal to generate a modulated clock signal, and treating a video data based on the modulated clock signal to generate a treated video data for driving the liquid crystal display device.

In yet another aspect, a method of driving a liquid crystal display device having a display panel and a driving circuit includes generating a frequency modulation signal corresponding to at least one of a temperature of the liquid crystal display device and an ambient temperature of the liquid crystal display device, modulating a frequency of a clock signal based on the frequency modulation signal to generate a modulated clock signal, treating a video data using the modulated clock signal to generate a treated video data, and driving the display panel based on the modulated clock signal and the treated video data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
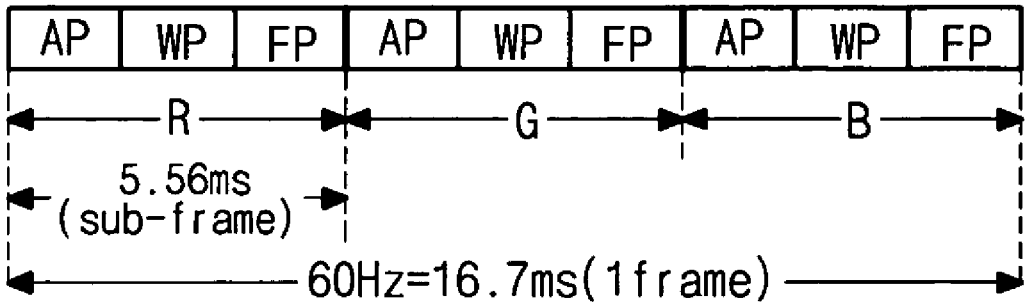
FIG. 1 Related Art
FIG. 1 is a schematic diagram showing a single time frame of a field sequential color (FSC) driving method for a liquid crystal display device according to the related art.
Figure 2A:
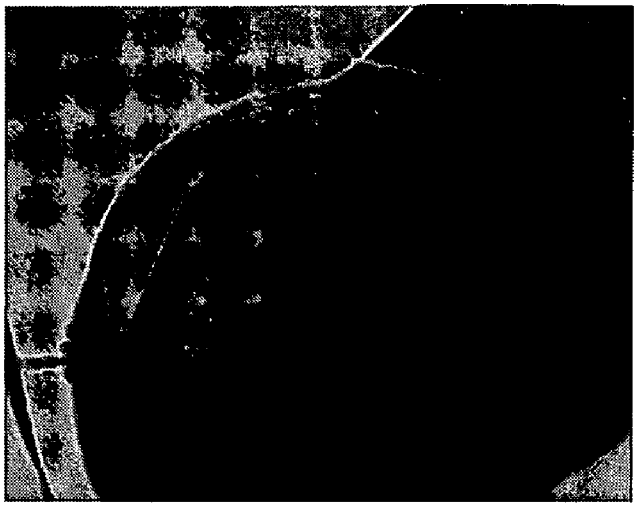
FIG. 2A Related Art
FIGS. 2A and 2B are images showing display qualities of an FSC mode liquid crystal display device according to the related art at different temperatures.
Figure 2B:
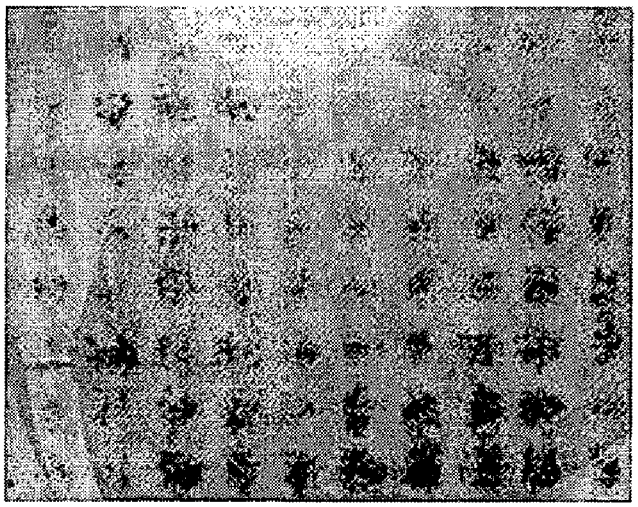
FIG. 2B Related Art
Figure 3:
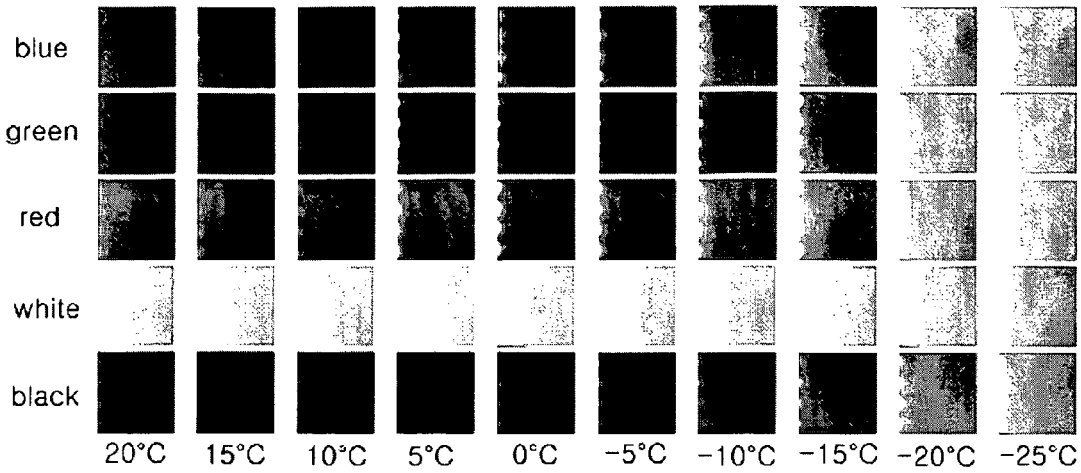
FIG. 3 Related Art
FIG. 3 is a collection of images showing display qualities of an FSC mode liquid crystal display device according to the related art at different temperatures.
Figure 4:
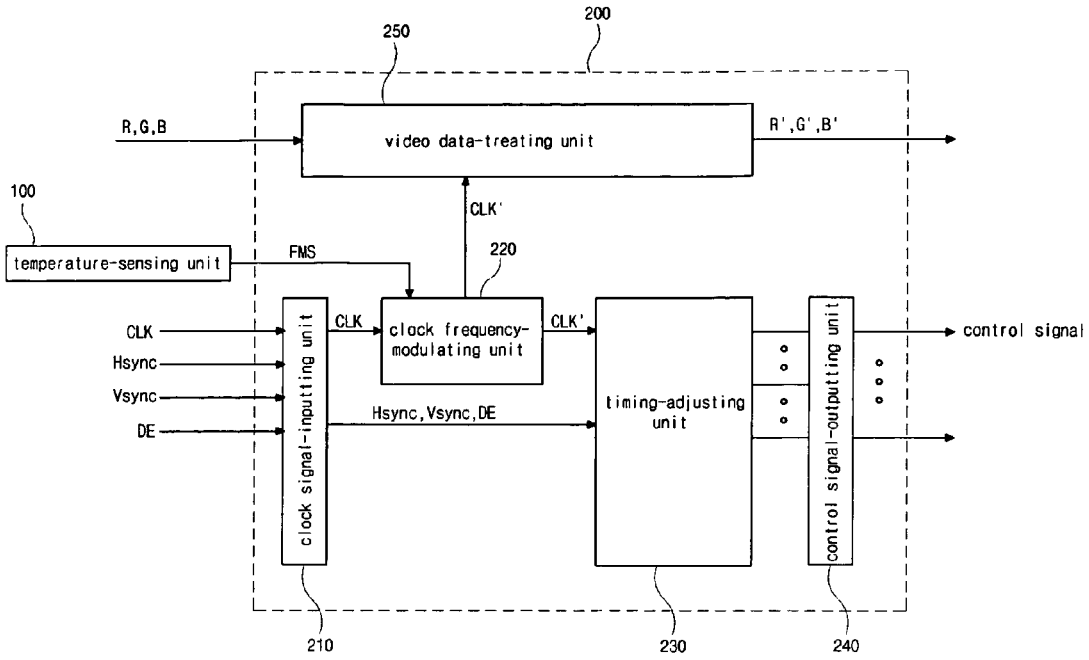
FIG. 4 is a schematic block diagram showing a temperature-compensating circuit for a field sequential color mode liquid crystal display device according to an embodiment of the present invention.

FIG. 4 is a schematic block diagram showing a temperature-compensating circuit for a field sequential color mode liquid crystal display device according to an embodiment of the present invention. In FIG. 4, a temperature-compensating circuit includes a temperature-sensing unit 100 and a timing controller 200. The temperature-sensing unit 100 outputs a frequency modulation signal FMS to the timing controller 200 and the timing controller 200 modulates a frequency of a driving clock according to the FMS.

The temperature-sensing unit 100 may continuously measure a temperature of an LCD device and/or the ambient temperature of the LCD device. For example, the temperature-sensing unit 100 may employ a temperature sensor having a thin film transistor (TFT), such that the TFT and switching elements of the LCD device can be simultaneously formed, or the temperature-sensing unit 100 may employ a thermo element. In addition, the temperature-sensing unit 100 generates the frequency modulation signal FMS by comparing the measured temperatures with at least one reference temperature to categorize the temperature of the LCD device into one of two categories. Alternatively, the temperature-sensing unit 100 may compare the measured temperatures with two reference temperatures, e.g., 5° C. and 0° C., to categorize the temperature of the LCD device into one of three categories: (1) higher than or equal to 5° C.; (2) lower than 5° C. and higher than 0° C.; and (3) lower than or equal to 0° C.

In addition, the timing controller 200 includes a clock signal-inputting unit 210, a clock frequency-modulating unit 220, a timing-adjusting unit 230, a control signal-outputting unit 240, and a video data-treating unit 250. The clock signal-input unit 210 may function as an input buffer receiving a clock signal CLK, a horizontal synchronization signal Hsync, a vertical synchronization signal Vsync, and a data enable signal DE from an exterior unit, such as a video card.

Further, the clock frequency-modulating unit 220 receives the clock signal CLK from the clock signal-inputting unit 210, modulates a frequency of the clock signal CLK to generate a modulated clock signal CLK', and outputs the modulated clock signal CLK' to the timing-adjusting unit 230.

In particular, since the viscosity of the liquid crystal molecules increases according to decrease of temperature, the clock frequency-modulating unit 220 generates a modulated clock signal CLK' having a frequency inversely proportional to the temperature. For example, when the clock signal CLK having a frequency of about 60 Hz is input to the clock frequency-modulating unit 220 from the clock-signal inputting unit 210, the clock frequency-modulating unit 220 may generate a modulated clock signal CLK' having a frequency of about 45 Hz if the temperature of the LCD device is between 0° C. and 5° C. and may generate a modulated clock signal CLK' having a frequency of about 30 Hz if the temperature of the LCD device is lower than about 0° C. However, the modulated clock signal CLK' may preferably not have a frequency lower than a limit value for recognition of frame change, e.g., about 15 Hz.

Moreover, the timing-adjusting unit 230 receives the modulated clock signal CLK', the horizontal synchronization signal Hsync, the vertical synchronization signal Vsync, and the data enable signal DE. The timing-adjusting unit 230 then generates a plurality of control signals for controlling a gate driving integrated circuit (IC) and a data driving IC (not shown) based on the received modulated clock signal CLK', horizontal synchronization signal Hsync, vertical synchronization signal Vsync, and data enable signal DE. In particular, the timing-adjusting unit 230 may output the plurality of control signals to the control signal-outputting unit 240 that functions as an output buffer outputting the plurality of control signals to the gate driving IC and the data driving IC (not shown).

The video data-treating unit 250 receives red, green and blue video data R,G,B from an exterior unit such as a video card. The video data-treating unit 250 may include a plurality of buffers, a latch and a module to treat the red, green and blue video data R,G,B. In particular, the video data-treating unit 250 receives the modulated clock signal CLK' from the clock frequency-modulating unit 220 and converts the red, green and blue video data R,G,B to treated red, green and blue video data R',G',B' based on the modulated clock signal CLK'.

Accordingly, the FSC mode LCD device is driven based on the modulated clock signal CLK'. For example, the temperature-compensating circuit may generate a modulated clock signal CLK' having a lower frequency of about 30 Hz under a circumstance where the temperature is lower than about 0° C. to drive the FSC mode LCD device. As a result, a sufficient response time of liquid crystal molecules is ensured and display qualities of the FSC mode LCD device are improved.

Figure 5:
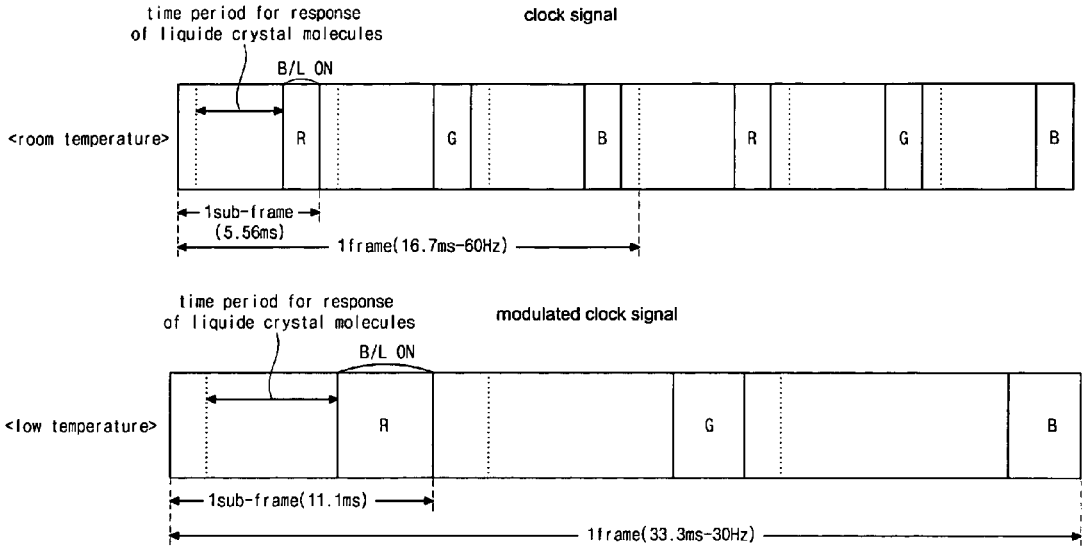
FIG. 5 is a schematic timing chart showing a driving method of a field sequential color mode liquid crystal display device according to an embodiment of the present invention.

FIG. 5 is a schematic timing chart showing a driving method of a field sequential color mode liquid crystal display device according to an embodiment of the present invention. As shown in FIG. 5, in a driving method of an FSC mode LCD device may have a clock signal having a frequency of about 60 Hz under a room temperature and a modulated clock signal having a frequency of about 30 Hz under a temperature lower than about 0° C. In particular, when the FSC mode LCD device is operated under a room temperature, one frame and one sub-frame for each of red, green and blue colors may correspond to about 16.7 ms and about 5.56 ms, respectively. In addition, when the FSC mode LCD device is operated under a low temperature, one frame and one sub-frame may correspond to about 33.3 ms and about 11.1 ms, respectively. Accordingly, a time period for response of liquid crystal molecules under a low temperature is longer than that under a room temperature. Since the liquid crystal molecules of the FSC mode LCD device has a sufficient time period for responding even under a low temperature, the liquid crystal molecules are completely arranged and the display qualities of the FSC mode LCD device are not deteriorated.

Figure 6:
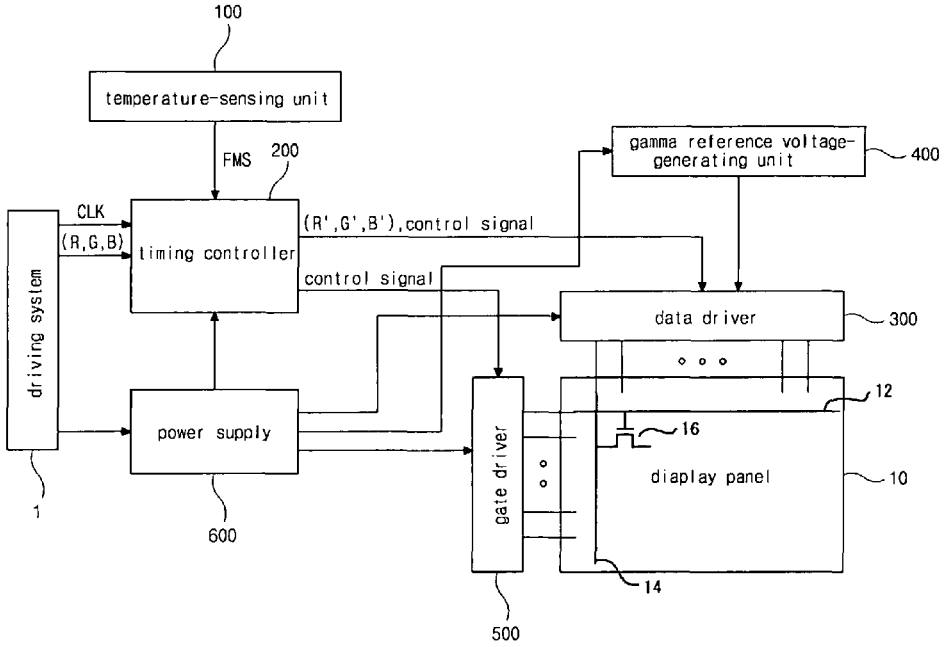
FIG. 6 is a schematic block diagram showing a field sequential color mode liquid crystal display device according to an embodiment of the present invention.

FIG. 6 is a schematic block diagram showing a field sequential color mode liquid crystal display device according to an embodiment of the present invention. In FIG. 6, a liquid crystal display device includes a driving system 1, a display panel 10, a temperature-sensing unit 100, a timing controller 200, a gamma reference voltage-generating unit 400, a data driver 300, a gate driver 500, and a power supply 600. The driving system 1 serially outputs a clock signal CLK, red, green and blue video data R,G,B, a horizontal sync signal (not shown), a vertical sync signal (not shown) and a data enable signal (not shown) to the timing controller 200. In addition, the temperature-sensing unit 100 may continuously measure a temperature of an LCD device and/or the ambient temperature of the LCD device, and outputs a frequency modulation signal FMS to the timing controller 200.

The timing controller 200 may have a similar structure as shown in FIG. 4. In addition, the timing controller 200 outputs a plurality of control signals to the data driver 400 and the gate driver 500. In particular, the timing controller 200 modulates a frequency of the clock signal CLK based on the frequency modulation signal FMS to generate a modulated clock signal (not shown). For example, the timing controller 200 may generate a modulated clock signal to have a lower frequency when the FSC mode LCD device is under a low temperature. In addition, the timing controller 200 treats the red, green and blue video data R,G,B based on the modulated clock signal to output treated red, green and blue video data R',G',B' to the data driver 300.

Moreover, the display panel 10 includes a plurality of gate lines and data lines 12 and 14 arranged in a matrix manner. The display panel 10 further includes a switching element 16 and a liquid crystal layer (not shown). The gamma reference voltage-generating unit 400 outputs a gamma reference voltage for the treated red, green and blue video data "R',G',B'" to the data driver 300. Further, the power supply 600 supplies a source power to each unit of the LCD device, such as the timing controller 200, the data driver 300, the gamma reference voltage-generating unit 400, and the gate driver 500. At the outset, the Examiner is thanked for the thorough review and consideration of the pending application.

Accordingly, when the FSC mode LCD device is under a low temperature, a frequency of the clock signal is modulated to have a lower value. As a result, a sufficient response time of liquid crystal molecules is ensured and the LCD device displays images without reduction of display qualities, such as contrast ratio and color reproducibility even under a low temperature.

Figure 7:
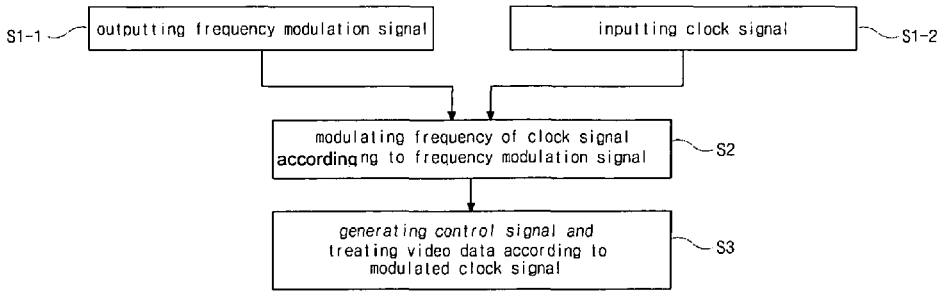
FIG. 7 is a flow chart illustrating an operation of a temperature-compensating circuit of a field sequential color mode liquid crystal display device according to an embodiment of the present invention.

FIG. 7 is a flow chart illustrating an operation of a temperature-compensating circuit of a field sequential color mode liquid crystal display device according to an embodiment of the present invention. In FIG. 7, a driving system 1 (of FIG. 6) outputs a clock signal "CLK" (of FIG. 6), red, green and blue video data "R,G,B" (of FIG. 6), a horizontal sync signal, a vertical sync signal and a data enable signal to a timing controller 200 (of FIG. 6) and the timing controller 200 (of FIG. 6) outputs a grey level signal to a gamma reference voltage-generating unit 400 (of FIG. 6). In addition, a power supply 600 (of FIG. 6) supplies a power to each unit of the LCD device.

As shown in FIG. 7, at step S1-1, a frequency modulation signal may be outputted. For example, the temperature-sensing unit 100 (shown in FIG. 6) may continuously measure a temperature of an LCD device and/or the ambient temperature of the LCD device, and may output the frequency modulation signal (FMS) by comparing. the measured temperature with at least one reference temperature. In addition, at step S1-2, the clock signal may be inputted. For example, the clock signal CLK, and red, green and blue video data R,G,B (shown in FIG. 6) may be inputted to the timing controller 200 (shown in FIG. 6).

Further, at step S2, the frequency of the inputted clock signal may be modulated based on the frequency modulation signal. For example, the timing controller 200 (shown in FIG. 6) may modulate a frequency of the clock signal CLK (shown in FIG. 6) based on the frequency modulation signal outputted by the temperature-sensing unit 100 (shown in FIG. 6) to generate a modulated clock signal.

Moreover, at step S3, at least one control signal may be generated according to the modulated clock signal, and video data also may be treated according to the modulated clock signal. For example, as shown in FIG. 6, the timing controller 200 may treat the red, green and blue video data R,G,B based on the modulated clock signal to generate treated red, green and blue video data R',G',B', and also may generate a plurality of control signals based on the modulated clock signal CLK'. Further, as shown in FIG. 6, the treated red, green and blue video data R',G',B' and a data control signal of the plurality of control signals may be inputted to the data driver 300, and a gate control signal of the control signals may be inputted to the gate driver 500.

Since the FSC mode LCD device is driven with the modulated clock signal having various frequencies according to a measured temperature of an LCD device and/or the measure ambient temperature of the LCD device, a sufficient response time of liquid crystal molecules is ensured and display qualities of the FSC mode LCD device are improved in spite of an increase in viscosity of the liquid crystal molecules under a low temperature. For example, the FSC mode LCD device may be driven with a modulated clock signal having a frequency of about 45 Hz under a temperature between about 5° C. and about 0° C., and may be driven with a modulated clock signal having a frequency of about 30 Hz under a temperature lower than about 0° C.

Even though the temperature-compensating circuit is applied to an FSC mode LCD device in an exemplary embodiment of the present invention, the temperature-compensating circuit may be applied to an LCD device that is driven with a conventional driving method. Although not shown, in another embodiment of the present invention, a temperature range may be divided into a plurality of groups using a plurality of reference temperatures and a plurality of modulated clocks having different frequencies may be used for the plurality of groups.

As a result, in a field sequential color (FSC) mode liquid crystal display (LCD) device including a temperature-compensating circuit according to the present invention, color reproducibility and contrast ratio under a low temperature are improved. Since the temperature-compensating circuit modulates a frequency of a clock signal in accordance with a temperature condition and a viscosity of liquid crystal molecules of the FSC mode LCD device, the liquid crystal molecules have a sufficient time period for responding and are completely arranged even under a low temperature.

It will be apparent to those skilled in the art that various modifications and variations can be made in the field sequential color mode liquid crystal display device and a driving method thereof of the present invention without departing from the spirit or scope of the invention. Thus, it is intended that the present invention covers the modifications and variations of this invention provided they come within the scope of the appended claims and their equivalents.

What is claimed is:

1. A Field Sequential Color (FSC) mode liquid crystal display (LCD) device, comprising:

a temperature-sensing unit measuring at least one of a temperature of the liquid crystal display device and an ambient temperature of the liquid crystal display device, and outputting a frequency modulation signal corresponding to the measured temperature wherein the temperature-sensing unit generates the frequency modulation signal by comparing measured temperatures with at least one reference temperature to categorize the temperature of the LCD device, and wherein the at least one reference temperature includes two reference temperatures corresponding to 0° C. and 5° C.;

a timing controller modulating a frequency of a clock signal, which is output from an external video card, based on the frequency modulation signal to generate a modulated clock signal, and treating a video data based on the modulated clock signal to generate a treated video data, wherein the timing controller comprises:

a clock signal-inputting unit transmitting the clock signal, a plurality of synchronization signals and a data enable signal;

a clock frequency-modulating unit modulating the frequency of the clock signal based on the frequency modulation signal to generate the modulated clock signal;

a timing-adjusting unit receiving the modulated clock signal from the clock frequency-modulating unit and generating a plurality of control signals based on the modulated clock signal, the plurality of synchronization signals and the data enable signal;

a control signal-outputting unit transmitting the plurality of control signals; and a video data-treating unit receiving the modulated clock signal from the clock frequency-modulating unit to convert the video data to the treated video data based on the modulated clock signal; and a display panel displaying an image by a frame based on the modulated clock signal and the treated video data, the display panel including a gate line, a data line crossing the gate line and a switching element connected to the gate line and the data line;

a data driver applying a gamma reference voltage corresponding to the treated video data to the data line; and a gate driver applying a gate signal to the gate line;

wherein the clock signal has a frequency of about 60 Hz under a room temperature, and the modulated clock signal has a frequency of about 45 Hz under a temperature between about 5° C. and about 0° C. and has a frequency of about 30 Hz under a temperature lower than about 0° C., wherein the frame includes three sub-frames corresponding to red-color, green-color and blue-color light sources, wherein each of the three sub-frames includes a first period for inputting the video data or the treated video data, a second period for re-arranging a liquid crystal molecule and a third period for emitting light using the red-color, green-color and blue-color light sources, wherein the treated video data is treated such that the first, second and third periods for the treated video data are longer than the first, second and third periods for the video data, respectively, in correspondence to a decrease in temperature such that both a total frame period and a total sub-frame period for the red-color, green-color and blue-color light sources are correspondingly increased, and wherein the temperature-sensing unit includes a temperature sensor having a thin film transistor that is simultaneously formed with the switching element.

2. The device according to claim 1, wherein when the at least one of the measured temperature of the liquid crystal display device and the measured ambient temperature of the liquid crystal display device is below a reference temperature, a frequency of the modulated clock signal is smaller than a frequency of the clock signal.

3. The device according to claim 1, wherein a frequency of the modulated clock signal decreases as the measured temperature decreases.

4. The device according to claim 1, further comprising:

a driving system receiving the video data and the clock signal from an external source and outputting the received video data and the received clock signal to the timing controller.

5. The device according to claim 1, further comprising:

a gamma reference voltage-generating unit generating the gamma reference voltage.

6. The device according to claim 1, wherein the temperature-sensing unit includes a temperature sensor having one of a thin film transistor and a thermo element.

7. A temperature-compensating circuit for a liquid crystal display (LCD) device displaying an image by a frame, comprising:

a temperature-sensing unit measuring at least one of a temperature of the liquid crystal display device and an ambient temperature of the liquid crystal display device, and outputting a frequency modulation signal corresponding to the measured temperature wherein the temperature-sensing unit generates the frequency modulation signal by comparing measured temperatures with at least one reference temperature to categorize the temperature of the LCD device, and wherein the at least one reference temperature includes two reference temperatures corresponding to 0° C. and 5° C.;

a timing controller modulating a frequency of a clock signal, which is output from an external video card, based on the frequency modulation signal to generate a modulated clock signal, and treating a video data based on the modulated clock signal to generate a treated video data for driving the liquid crystal display device;

a display panel displaying the image corresponding to the treated video data, the display panel including a gate line, a data line crossing the gate line, and a switching element connected to the gate line and the data line;

a data driver applying a gamma reference voltage corresponding to the treated video data to the data line; and a gate driver applying a gate signal to the gate line;

wherein the timing controller comprises:

a clock signal-inputting unit transmitting the clock signal, a plurality of synchronization signals and a data enable signal;

a clock frequency-modulating unit modulating the frequency of the clock signal based on the frequency modulation signal to generate the modulated clock signal;

a timing-adjusting unit receiving the modulated clock signal from the clock frequency-modulating unit and generating a plurality of control signals based on the modulated clock signal, the plurality of synchronization signals and the data enable signal;

a control signal-outputting unit transmitting the plurality of control signals; and a video data-treating unit receiving the modulated clock signal from the clock frequency-modulating unit to convert the video data to the treated video data based on the modulated clock signal, wherein the clock signal has a frequency of about 60 Hz under a room temperature, and the modulated clock signal has a frequency of about 45 Hz under a temperature between about 5° C. and about 0° C. and has a frequency of about 30 Hz under a temperature lower than about 0° C., wherein the frame includes three sub-frames corresponding to red-color, green-color and blue-color light sources, wherein each of the three sub-frames includes a first period for inputting the video data or the treated video data, a second period for re-arranging a liquid crystal molecule and a third period for emitting light using the red-color, green-color and blue-color light sources, wherein the treated video data is treated such that the first, second and third periods for the treated video data are longer than the first, second and third periods for the video data, respectively, in correspondence to a decrease in temperature such that both a total frame period and a total sub-frame period for the red-color, green-color and blue-color light sources are correspondingly increased, and wherein the temperature-sensing unit includes a temperature sensor having a thin film transistor that is simultaneously formed with the switching element.

8. The circuit according to claim 7, wherein when the at least one of the temperature of the liquid crystal display device and the ambient temperature of the liquid crystal display device is below a reference temperature, a frequency of the modulated clock signal is smaller than a frequency of the clock signal.

9. The circuit according to claim 7, wherein a frequency of the modulated clock signal decreases as the measured temperature decreases.

10. The circuit according to claim 7, wherein the clock signal, the plurality of sync signals, the data enable signal and the video data are output from the external video card.

11. The circuit according to claim 7, wherein the temperature-sensing unit includes a temperature sensor having one of a thin film transistor and a thermo element.

12. A liquid crystal display device comprising the temperature-compensating circuit according to claim 7, wherein the liquid crystal display device includes:

a driving system supplying the video data and the clock signal to the temperature-compensating circuit.

13. A method of driving a Field Sequential Color (FSC) mode liquid crystal display (LCD) device having a display panel and a driving circuit, comprising:

sensing at least one of a temperature of the liquid crystal display panel and an ambient temperature of the liquid crystal display device with a temperature sensor;

generating a frequency modulation signal corresponding to at least one of the sensed temperature of the liquid crystal display device and the sensed ambient temperature of the liquid crystal display device;

generating the frequency modulation signal by comparing measured temperatures with at least one reference temperature to categorize the temperature of the LCD device, wherein the at least one reference temperature includes two reference temperatures corresponding to 0° C. and 5° C.;

modulating a frequency of a clock signal, which is output from an external video card, based on the frequency modulation signal to generate a modulated clock signal in a clock frequency-modulating unit of a timing-controller of the LCD device;

receiving the modulated clock signal from the clock frequency-modulating unit and generating a plurality of control signals using the modulated clock signal in a timing-adjusting unit of the timing-controller of the LCD device;

receiving the modulated clock signal from the clock frequency-modulating unit and converting a video data using the modulated clock signal to a treated video data in a video data-treating unit of the timing-controller of the LCD device; and driving the display panel to display an image by a frame based on the modulated clock signal and the treated video data, wherein the clock signal has a frequency of about 60 Hz under a room temperature, and the modulated clock signal has a frequency of about 45 Hz under a temperature between about 5° C. and about 0° C. and has a frequency of about 30 Hz under a temperature lower than about 0° C., wherein the frame includes three sub-frames corresponding to red-color, green-color and blue-color light sources, wherein each of the three sub-frames includes a first period for inputting the video data or the treated video data, a second period for re-arranging a liquid crystal molecule and a third period for emitting light using the red-color, green-color and blue-color light sources, wherein the treated video data is treated such that the first, second and third periods for the treated video data are longer than the first, second and third periods for the video data, respectively, in correspondence to a decrease in temperature such that both a total frame period and a total sub-frame period for the red-color, green-color and blue-color light sources are correspondingly increased, and wherein the temperature sensor includes a thin film transistor that is simultaneously formed with a switching element connected to a gate line and a data line of the display panel.

* * * * *